United States Patent [19]

Stargardter

[11] Patent Number: 4,512,718

[45] Date of Patent: Apr. 23, 1985

[54] TANDEM FAN STAGE FOR GAS TURBINE ENGINES

[75] Inventor: Hans Stargardter, Bloomfield, Conn.

[73] Assignee: United Technologies Corporation, Hartford, Conn.

[21] Appl. No.: 434,215

[22] Filed: Oct. 14, 1982

[51] Int. Cl.[3] ..... F04D 29/38

[52] U.S. Cl. ..... 416/231 B; 416/201 R; 415/181; 415/DIG. 1

[58] Field of Search ..... 416/231 B, 201 R, 200 R, 416/200 A; 415/119, 181, DIG. 1, 213 C

[56] References Cited

U.S. PATENT DOCUMENTS

| | | | |
|---|---|---|---|
| 2,314,572 | 3/1943 | Chitz | 416/130 X |
| 2,938,662 | 5/1960 | Eckert et al. | 415/DIG. 1 |
| 2,953,295 | 9/1960 | Stalker | 415/181 |
| 2,982,361 | 5/1961 | Rosen | 415/DIG. 1 |
| 3,075,743 | 1/1963 | Sheets | 415/DIG. 1 |
| 3,173,604 | 3/1965 | Sheets et al. | 415/213 C |
| 3,193,185 | 7/1965 | Erwin et al. | 415/213 C X |
| 3,244,400 | 4/1966 | Saunders | 416/231 B |
| 3,606,579 | 9/1971 | Mehus | 416/200 |
| 3,692,425 | 9/1972 | Erwin | 416/201 R X |
| 3,867,062 | 2/1975 | Troller | 415/DIG. 1 X |

FOREIGN PATENT DOCUMENTS

| | | | |
|---|---|---|---|
| 390486 | 2/1924 | Fed. Rep. of Germany | 416/231 B |
| 53218 | 5/1967 | Poland | 416/91 |
| 315483 | 7/1929 | United Kingdom | 416/231 B |
| 630747 | 10/1949 | United Kingdom | 415/213 C |
| 274302 | 6/1970 | U.S.S.R. | 416/231 B |
| 714024 | 2/1980 | U.S.S.R. | 416/231 B |

*Primary Examiner*—Everette A. Powell, Jr.
*Attorney, Agent, or Firm*—Robert C. Walker

[57] ABSTRACT

A fan rotor assembly having decreased susceptibility to vibratory damage is disclosed. In one embodiment described the rotor assembly includes a plurality of principal fan blades 22 and a plurality of secondary fan blades 36 associated therewith. The secondary blades are coextensive with the principal fan blades over the inner portion of the principal blade span.

5 Claims, 4 Drawing Figures

TANDEM FAN STAGE FOR GAS TURBINE ENGINES

DESCRIPTION

1. Technical Field

The invention relates to turbofan gas turbine engines and more specifically to the control of vibratory stresses in the fan blades of such engines.

2. Background Art

Scientists and engineers working in the turbine engine field have long recognized that vibratory damage may adversely limit the life of rotor blades. Where the operating speed of the engine in revolutions per second, or multiple thereof, is equal to the natural frequency of the blade system, each of the individual blades is likely to resonate. At resonance a vibratory deflection of large amplitude is induced by relatively small amplitude stimuli as the stimuli act in reforcing concert with the periodic deflections of the blade. The large amplitude deflections produce severe mechanical stresses in the blade material and ultimately cause failure of the blade.

Struts or other protuberances within the engine flowpath precipitate nonuniform pressure patterns sequentially exciting the passing blades. In the case of a single protuberance a single excitation per revolution, 1E, is established. The frequency of the 1E excitation in a gas turbine engine is normally below the fundamental natural frequency of the rotor blade system and is rarely of concern to engine designers.

The 2E excitation frequency occurs as two pulses are generated for each revolution of the rotor and often coincides with the fundamental natural bending frequency of a desired blade system. The 2E excitation is particularly severe for front end blades, such as fan blades. In such blades the traditionally preferred geometric shapes and contours have inherent natural frequencies which may approximate the 2E excitation frequency within the engine operating range and may produce vibratory damage. Such vibratory damage at the 2E frequency is avoided by reducing the amplitude of the stimuli, or by altering the natural frequency of the blade system.

One technique for reducing the natural frequency of the blade system is described in U.S. Pat. No. 4,076,455 to Stargardter entitled "Rotor Blade System for a Gas Turbine Engine". In accordance with that teaching the stiffness of the blade in the root region is decreased by pinning the root to the supporting disk structure. Notwithstanding, pin structures have some disadvantages and are not suited for use in all engine applications.

Other techniques for reducing the fundamental natural frequency of the desired fan blades are sought and it is to this end that the present invention is directed.

DISCLOSURE OF THE INVENTION

According to the present invention resonance in bending of the fan blades of a gas turbine engine is avoided by limiting the individual camber of the fan blades in the inner span region and augmenting the flow turning capability of each fan blade at the inner span region by the addition of one or more secondary fan blades extending over that region to maintain the fundamental natural frequency of the rotor blades below multiples of the fan rotating speed throughout the engine flight cycle.

The primary feature of the present invention is the limited camber of the principal fan blade. One or more secondary fan blades in association with the principal fan blade produce, in combination, the aerodynamic effect. The secondary fan blade extends into the working medium flowpath over the initial region of the principal blade span to increase the amount of flow turning near the principal blade root.

A significant advantage of the present invention is the reduced fundamental natural frequency of the principal fan blades. The natural frequency of the fan rotor blades is maintained below the 2E frequency of the fan rotor over the flight cycle of the engine in which the fan blades are installed. Flow turning at the inner span of the peripheral fan blades is augmented by the secondary fan blades to form in composite an airfoil having the desired turning capacity. The principal and secondary fan blades have an aerodynamic camber which approximates the camber of the desired single fan blade.

The foregoing features and advantages of the present invention will become more apparent in the light of the following detailed description of the best mode for carrying out the invention and in the accompanying drawing.

BEST MODE FOR CARRYING OUT THE INVENTION

Figure 1:
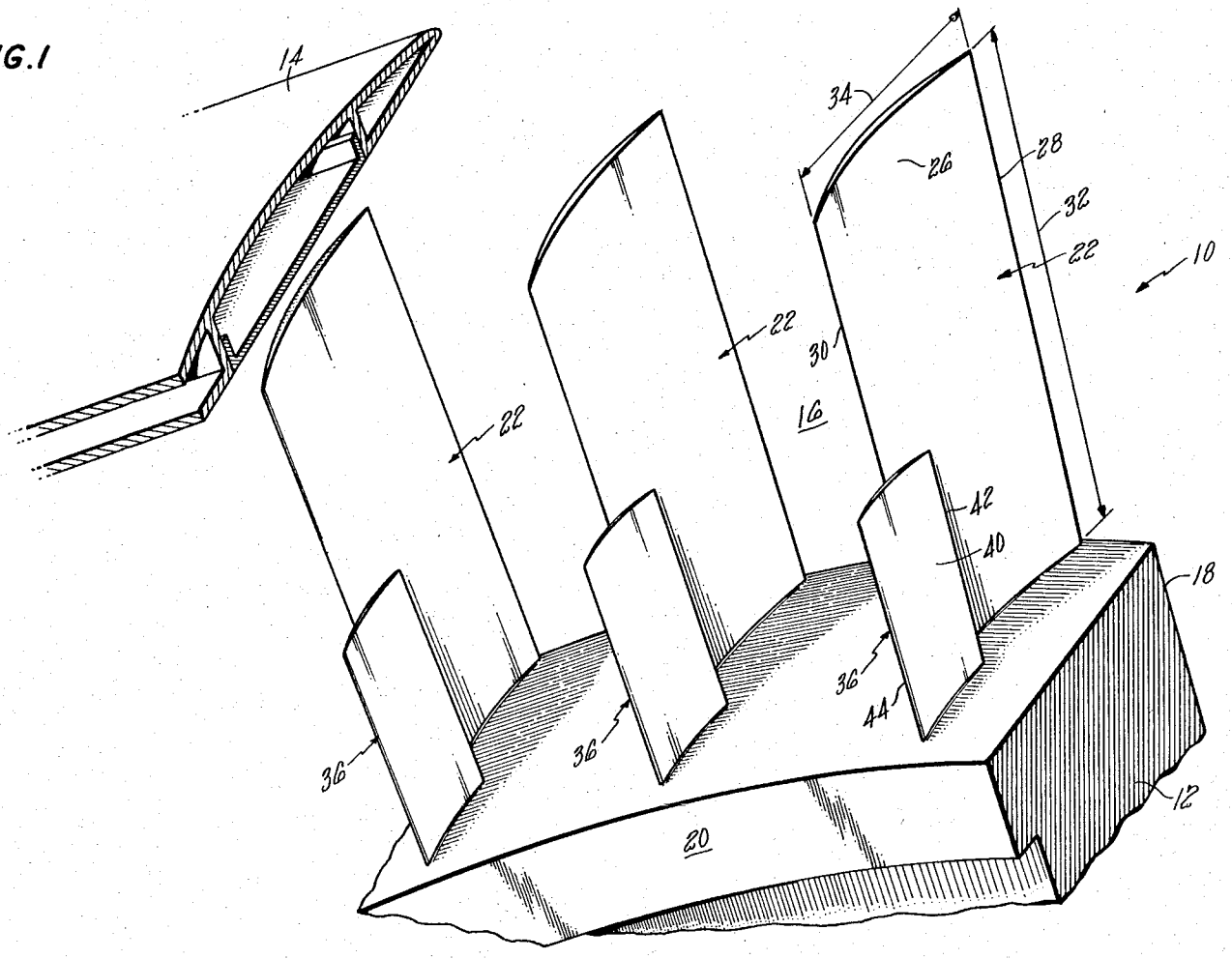
FIG. 1 is a simplified partial perspective view of the fan assembly of a turbofan gas turbine engine.

A portion of the fan assembly 10 of a turbofan gas turbine engine is illustrated in FIG. 1. The fan assembly principally comprises a fan disk 12 and a fan case 14 which define therebetween an annular flowpath 16 for working medium gases. The fan disk has an upstream end 18 and a downstream end 20. A plurality of principal fan blades 22 extend outwardly from the rotor disk across the flowpath for working medium gases into proximity with the fan case. Each fan blade is formed of a root section and an airfoil section 26. The airfoil section has a leading edge 28 and a trailing edge 30. The portion of the airfoil section which extends into the working medium flowpath is referred to as the blade span 32. A line between the leading edge and the trailing edge of the blade is referred to as the blade chord 34.

Each principal blade 22 has one or more secondary fan blades 36 associated therewith. In the embodiment shown the number of principal fan blades and the number of secondary fan blades are equal. Each secondary fan blade has a root and an airfoil section 40. The airfoil section has a leading edge 42 and a trailing edge 44. Where a single secondary fan blade is used, each such blade is positioned to the pressure side of the trailing edge of its associated principal fan blade. As illustrated the leading edge of the secondary fan blade extends upstream of the trailing edge of the principal fan blade and the trailing edge of the secondary fan blade extends downstream of the trailing edge of the principal fan blade.

Figure 2:
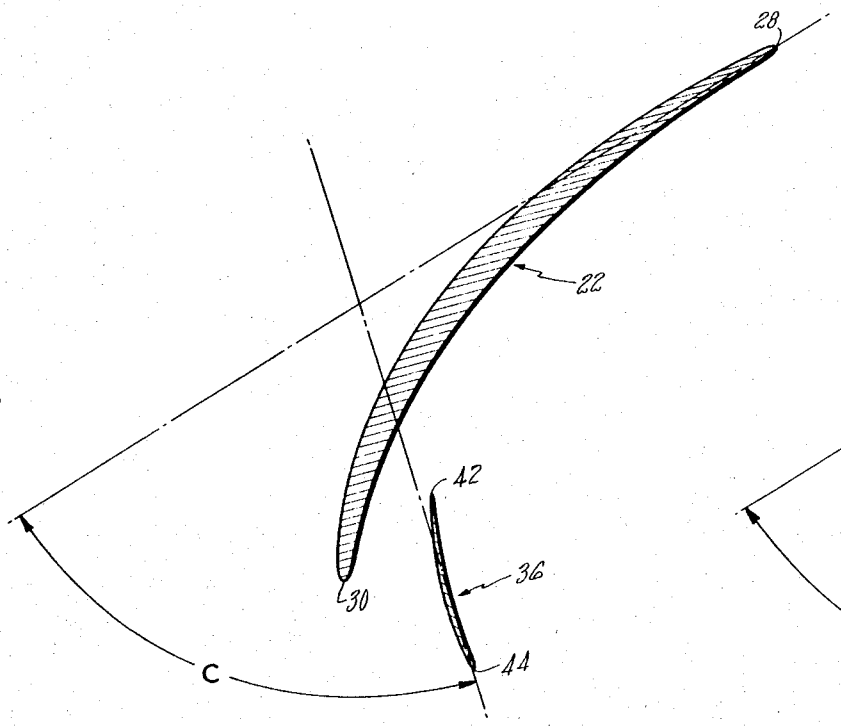
FIG. 2 is a cross-section view taken through a principal fan blade and its corresponding secondary blade illustrating the effective camber of the two blades in composite.

The aerodynamic effect of the principal fan blade and the secondary fan blade in tandem is illustrated in FIG. 2. The turning capacity of the blade is referred to as its camber angle C. A comparison of FIG. 2 with FIG. 3 (prior art) illustrates the aerodynamic capability of the two blades in tandem when compared to the geometry of a single blade having the same effective camber angle.

Figure 3:
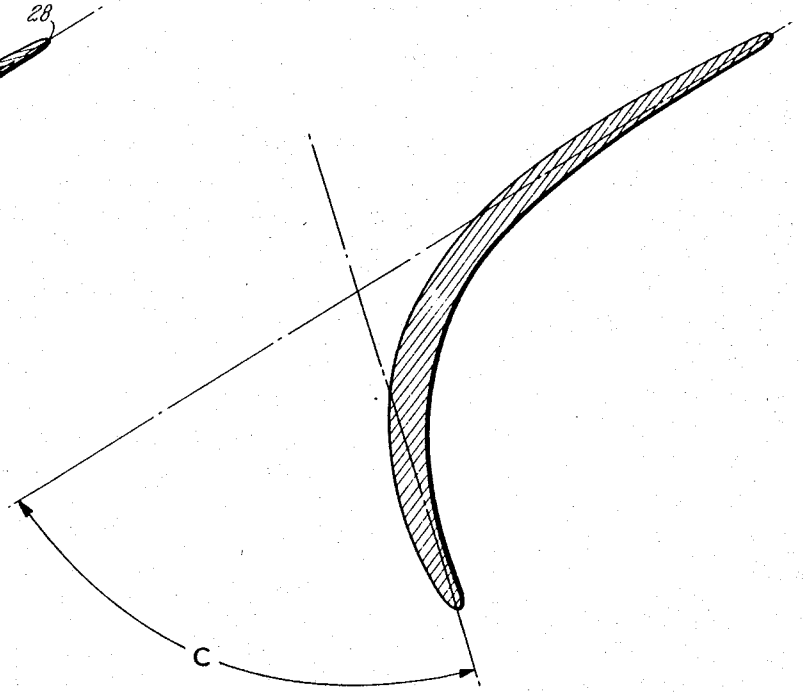
FIG. 3 (prior art) is a cross-section view comparable to the FIG. 2 view illustrating the contour of a single fan blade having the effective camber of the composite blade structure illustrated in FIG. 2.
Figure 4:
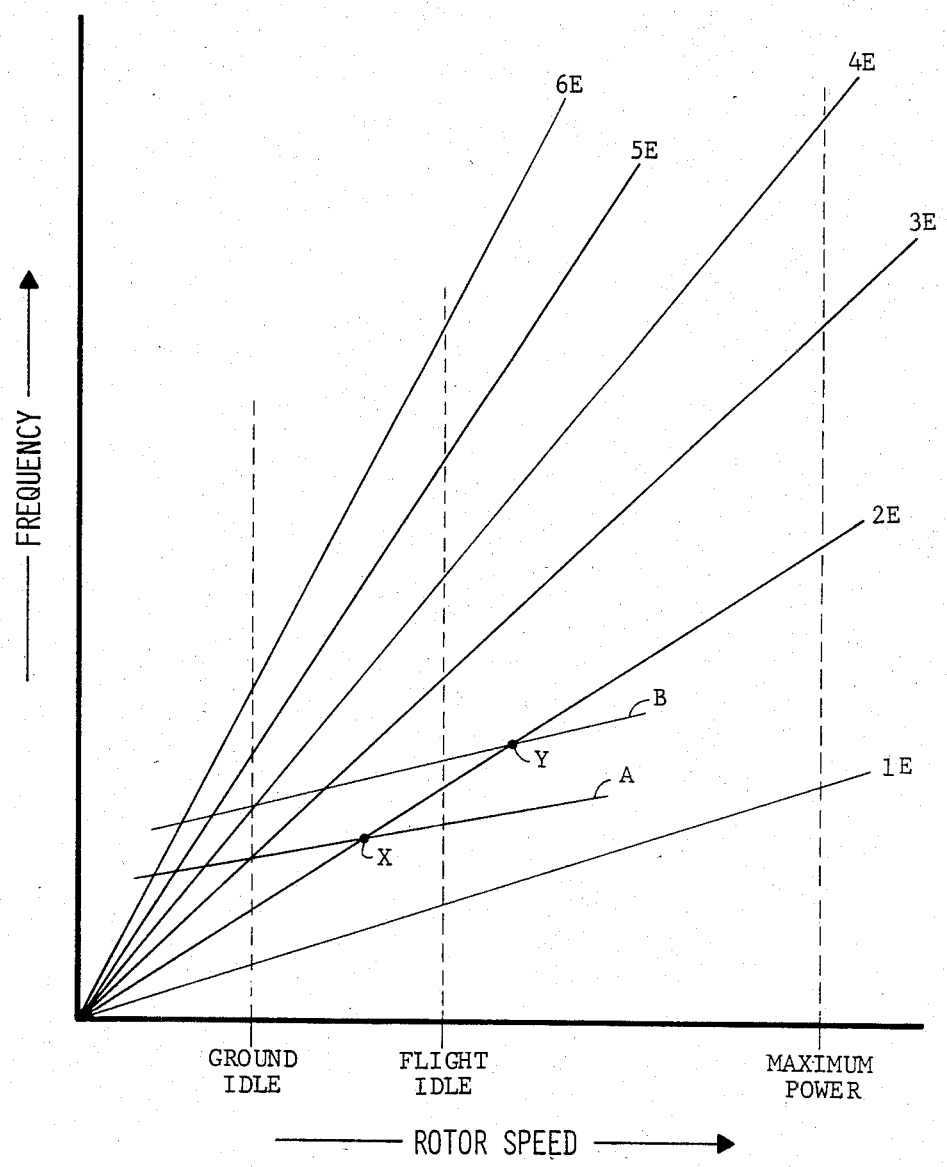
FIG. 4 is a resonance diagram illustrating the avoidance of fan blade resonance over the flight cycle of the engine in which the blade is installed.

The principal advantage of the tandem blade construction of FIG. 2 when compared to the single blade construction of FIG. 3 (prior art) is illustrated in the resonance diagram FIG. 4. The lines 2E, 3E, 4E, 5E and 6E represent multiples of the fan rotor speed. The fundamental natural frequency in the first bending mode of the principal blade of a tandem blade structure is illustrated at A. The fundamental natural frequency in the first bending mode of the corresponding single blade structure is illustrated at B. Resonance of the fan blade occurs upon the intersection of its natural frequency with a multiple of the engine rotor speed. Note that the tandem blade fundamental natural frequency intersects the 2E rotor speed line at a point X which lies below the flight idle speed of the engine and that the fundamental natural frequency of the comparable single blade intersects the 2E multiple of engine rotor speed at a point Y about the engine flight idle speed. Significantly, the tandem blade structure avoids resonance during the flight cycle of the engine. The likelihood of destructive vibratory modes being induced is avoided.

Bending stiffness is a function of both material thickness and blade camber. Torsional stiffness, on the other hand, is uniquely dependent on thickness. A reduction in camber, therefore, reduces the blade bending stiffness without a flutter inducing reduction in torsional stiffness as long as a comparable thickness is maintained.

A reduction in stiffness is evident by comparing the FIG. 2 and FIG. 3 (prior art) cross sections. The stiffness reduction is a result of decreased camber of the principal blade over about the lower quarter span. Lesser amounts of potential or strain energy are stored in the blade over each vibration cycle and the potential for vibratory damage is reduced.

Sufficient turning of the flow in the root region is enabled notwithstanding reduced camber angle through the addition of the secondary fan blade. Each secondary fan blade extends over only a portion of the blade span of its corresponding principal blade. In modern turbofan engines, a secondary fan blade need extend only on the order of ten to thirty percent (10–30%) of the principal blade span. An effective camber angle of approximately eighty degrees (80°) can be maintained with a principal fan blade having a forty degree (40°) camber angle and the balance provided by the secondary fan blade.

Other advantages of the tandem fan blade construction include closer correspondence of the principal fan blade airfoil with its attaching root. The transition between the airfoil and root is more easily accommodated and reduced stresses result. Additionally, untwist stresses associated with high camber blades are lowered in the reduced camber construction of the tandem blade concept. In some engine constructions it may even be possible to remove one low compressor stage in consideration of the high work output produced at the inner flowpath region by the tandem blade structure.

Although the invention has been shown and described with respect to detailed embodiments thereof, it should be understood by those skilled in the art that various changes in form and detail thereof may be made without departing from the spirit and the scope of the claimed invention.

What is claimed is:

1. A fan assembly for a turbofan gas turbine engine, wherein the fan assembly includes:

a fan disk;

a case circumscribing the fan disk and spaced apart therefrom to form a flowpath for working medium gases between the disk and the case;

a plurality of principal fan blades extending outwardly from the fan disk and across the flowpath for working medium gases into proximity with the circumscribing case, each blade having a camber angle which is sufficiently low such that the fundamental natural frequency of the blade in bending is less than the 2E multiple of engine rotor speed between flight idle and maximum power conditions for the turbofan engine in which the blade is installed;

a plurality of secondary fan blades at least one each corresponding to each principal blade and extending outwardly from the rotor disk near the trailing edge of the corresponding fan blade only partially across the flowpath for working medium gases wherein each principal fan blade and corresponding secondary fan blades form in composite the aerodynamic equivalent of a single blade having a camber greater than that of the principal fan blade.

2. The invention according to claim 1 wherein each principal fan blade has a single corresponding secondary fan blade associated therewith.

3. The invention according to claim 2 wherein each of said single secondary fan blades is displaced from the pressure side surface of the corresponding principal blade at the trailing edge region thereof.

4. The invention according to claim 3 wherein each principal fan blade has a camber angle on the order of forty degrees (40°).

5. The invention according to claim 3 wherein the effective camber angle of the principal fan blade and associated secondary fan blade is on the order of eighty degrees (80°).

* * * * *